United States Patent [19]

Romberg

[11] Patent Number: 4,756,974

[45] Date of Patent: Jul. 12, 1988

[54] ELASTOMERIC COMPONENT FOR PHARMACEUTICAL DEVICES

[75] Inventor: Val G. Romberg, Upper Darby, Pa.

[73] Assignee: The West Company Incorporated, Phoenixville, Pa.

[21] Appl. No.: 928,558

[22] Filed: Nov. 10, 1986

[51] Int. Cl.[4] ..... B32B 27/00

[52] U.S. Cl. ..... 428/423.9; 215/364; 215/315; 220/352

[58] Field of Search ..... 428/423.9; 215/364, 215/315; 220/352

[56] References Cited

U.S. PATENT DOCUMENTS

| | | | |
|---|---|---|---|
| 3,528,848 | 9/1970 | Zoebelein | 428/423.9 |
| 3,578,037 | 5/1971 | Flynn | 215/364 |
| 4,119,094 | 10/1978 | Micklus | 428/423.9 |
| 4,321,306 | 3/1982 | Eguchi | 215/364 |
| 4,554,125 | 11/1985 | Knapp | 215/364 |

*Primary Examiner*—Edith Buffalow

*Attorney, Agent, or Firm*—Eugene E. Renz, Jr.

[57] ABSTRACT

A stopper device for use on a pharmaceutical closure, comprising an elastomeric stopper sized to function as a closure; and a polyurethane coating on the stopper. The coating has a modulus sufficient to decrease the coefficient of friction of the stopper to less than 0.6.

15 Claims, No Drawings

ELASTOMERIC COMPONENT FOR PHARMACEUTICAL DEVICES

FIELD OF THE INVENTION

This invention relates to elastomeric components such as rubber stoppers which are useful in pharmaceutical devices such as medicine-containing vials. Specifically, the elastomeric components are coated with a polyurethane film in order to improve the coefficient of friction of the component and thereby improve manufacturing efficiency using conventional manufacturing equipment.

BACKGROUND OF THE INVENTION

For many years, the most successful closure system for pharmaceutical products has been the use of rubber stoppers in glass or high-density plastic vials. The glass and rubber combination has been useful for a wide variety of pharmaceutical ingredients combining both safe storage of the medicines and easy access through the rubber stopper. Particularly when liquids are contained in the vial, a needle can easily penetrate the rubber stopper to withdraw the desired amount of ingredient without otherwise interfering with the completeness of the closure.

Because of the success of this type of pharmaceutical device, and as more and more systems started using rubber stoppers in glass containers, the rate at which these devices can be manufactured after filling the container contributes greatly to the economic efficiencies of the otherwise desirable design. Conventional pharmaceutical devices which are useful for filling vials rely upon a mechanical implantation of the rubber stopper into the neck of the vial or other shaped container. Just prior to the mechanical insertion, the rubber stoppers are transported from a hopper to the filling equipment, usually by centrifugal or gravity feed. It is essential that the rubber components not hang up on the transfer equipment but rather flow smoothly into the capping or closure forming device. The equipment especially for transferring components is normally made from stainless steel or other materials which can be kept extremely clean for pharmaceutical purposes.

In the prior art, the high coefficient of friction of rubber stoppers and other rubber materials which are being fed to closure devices and other pharmaceutical devices, has been the limiting factor in the speed of the machine. Use of gravity, centrifugal or vibration feeding devices require that the rubber stoppers or other elastomeric components move smoothly over the surface of the feeding unit. Typically, rubber devices of the type used in pharmaceutical closures have coefficients of friction of at least 1.2, which clearly acts as an impediment to rapid movement.

One solution which has been proposed to improve the general processibility of rubber closures and which has at least kept the individual rubber stoppers from bonding to one another during autoclaving and other treating steps is the use of silicone oil as a coating on the outside of the stoppers. Silicone oil has improved the lubricity of the rubber closures but has added additional problems by increasing the particle count found in inspection of various drug solutions. The Federal Drug Administration evaluates processes by counting the number of particles present, without concern for what the particles are made from. Silicone oil is normally not an undesirable particle in medicine but still adds to the count of particles and, therefore, detracts from the overall acceptance of its use in processing equipment. While the amount of silicone oil is minimal, only that amount necessary to prevent the individual stoppers from sticking to one another, it has not adequately affected the coefficient of friction of rubber stoppers for use in high-speed capping equipment so as to give uniform, faster movement, particularly with centrifugal feeding systems. Finally, the rubber stoppers which have been treated by the use of silicone oil are not as effective in surviving chemical tests concerning the compatibility and the contamination of the materials contained in the vials.

At the present time, there does not appear to be any suggestion in the prior art which would suggest the improvement of the coefficient of friction of rubber while maintaining other properties necessary for effective pharmaceutical closures. In U.S. Pat. No. 2,951,053, Reuter et al discusses an elastic polyurethane composition which has improved friction properties. The polyurethane is used to produce articles having moving surfaces, such as bearing designs and the like. Silicone oil and/or hydrocarbons are introduced into the polyurethane material. There is absolutely no suggestion that polyurethane may be used as a coating on the rubber products. U.S. Pat. No. 4,147,679 discloses a polyurethane which is suitable for forming a coating on substrates such as plastics, foam and the like. The use of polyurethane to solve the deficiencies outlined above in the use of elastomeric components in pharmaceutical devices has not been suggested by any of the prior art.

SUMMARY OF THE INVENTION

Accordingly, it has now been discovered that an improved stopper device for use on pharmaceutical closures may be made in the following manner. The elastomeric component used in pharmaceutical devices comprises an elastomeric part such as a stopper which is sized to function as a closure and a polyurethane coating on the stopper. The coating is such that it has a modulus sufficient to decrease the coefficient of friction of the stopper to less than 0.6 and preferably to between 0.35 and 0.45. The elastomeric stopper is coated with a polyurethane coating, and preferably a water soluble polyurethane coating applied by conventional coating techniques and crosslinked to promote adhesion and resistance to heat and other factors. The modulus is selected to improve the hardness of the polyurethane coating so as to reduce the coefficient of friction of the stopper. Typically the modulus may range from less than 1000 to greater than 5000, although higher modulus readings do not significantly improve the coefficient of friction. The coating thickness will vary, depending upon the specific polymer being employed and the degree of crosslinking which needs to be achieved in order to effectively adhere the coating to the substrate. Typically, the coating will range from about at least 0.2 mil to as much as 1.5 mil or larger.

DETAILED DESCRIPTION OF THE PREFERRED EMBODIMENT

The device of this invention may be manufactured from any conventional elastomeric material which has been used in pharmaceutical devices wherein elastomeric component is required. Rubber stoppers of conventional design must meet certain tests in order to be useable in the pharmaceutical industry. The present invention, which comprises the addition of a polyurethane coating on the elastomeric component, should be capable of improving the coefficient of friction so that it permits the use of high-speed capping equipment so as to give uniform, faster movement of the materials, particularly when fed with a centrifugal feed. Elimination of silicone oil in processing substantially reduces the particles which are found in the solution contained in the vial being capped or closed. Even though silicone oil is not necessarily harmful in minute quantities in pharmaceutical solutions, governmental requirements such as FDA requirements, sometimes count particles rather than distinguishing between what the various kinds of particles are. Thus, even completely harmless particles would be counted against the satisfactory purity of the solution. Elimination of silicone particles would be a great advantage in the art.

The elastomeric component of the pharmaceutical devices is manufactured from any of the elastomeric compounds which have conventionally been used in the pharmaceutical industry. Natural rubber, of course, was the original choice of materials for many elastomeric formulations and components in the pharmaceutical industry. Butyl rubber and many of the synthetic rubbers have been successfully used as stoppers, depending upon the stability during autoclaving or other high stress situations. A particular rubber which is admirably suited for the purposes of functioning as a rubber stopper in vials is butyl rubber.

The present invention is intended to be used on all of the conventional, presently existing stoppers and other elastomeric articles which are available in the pharmaceutical industry. Accordingly, any stopper which has been used or which would be useable if the coefficient of friction would permit its use in high-speed machines is, therefore, contemplated for use as the first component of the present invention.

Presently available rubber products are admirably suited for their purpose except for the delay caused in high-speed machines, and accordingly, the present invention seeks to improve the stoppers' functionality in two areas and maintain its functionality in all of the rest. Specifically, the present invention contemplates improving the coefficient of friction for use in high-speed capping equipment, particularly with centrifugal feeds, and it also contemplates the elimination of silicone oil and other processing aids. The effectiveness of rubber stopper as a barrier and as a stopper and as a product resistant to chemical attack is intended to be maintained when the second component is applied. Because rubber stoppers currently in use are admirably suited except for the two features mentioned above, there is no significant reason for improving any of the other properties. Nonetheless, it is necessary to maintain the resistance to chemical attack and the other properties when applying a coating as described hereinafter.

Polyurethanes form the second component of the device of this invention and are applied as a coating to the elastomeric stopper or other device used in pharmaceutical environments. The coating must be extensible so that it will stretch and move with the underlying rubber. In a preferred embodiment, it is highly desirable that the coating material be water based so as to reduce capital equipment requirements for handling solvents other than water. This is particularly important in pharmaceutical processing so as to prevent contamination by unremoved solvents. In addition, flammability and toxicity are always of concern when solvents other than water are used.

Polyurethanes have become known as extensible and non-toxic. For example, polyurethanes in some forms have been made into components of artificial hearts.

In considering polyurethanes as a coating for elastomers for use in the pharmaceutical industry so as to improve the coefficient of friction as described above, various difficulties were encountered. Most of the polyurethanes which are satisfactory for resisting the autoclave process, wherein the products are sterilized, are solvent based and, therefore, have limited use in the pharmaceutical industry. Water-based polyurethanes presented a significant dilemma in that if it is dispersible in water, it most oftentimes is not capable of resisting intense water exposure such as is found in the various autoclave cycles which pharmaceutical closure products which must survive. Attempts to crosslink water-based polyurethanes were not initially successful since those crosslinking agents which rendered the coating autoclave resistant also formed a yellowing to the coating which was objectionable.

One particular family of polyurethanes which are useful in the present invention are the aliphatic urethane polymers manufactured by Sanncor Industries, Inc. under the trade name Sancure®. Specifically, Sancure®867 is an aliphatic water formed urethane polymer which can be employed in making the coatings of the present invention. This aliphatic urethane polymer supplied as an aqueous solution of approximately 40% by weight solids and is in the form of a high molecular weight colloidal dispersion. Sancure®847 is another similar aliphatic urethane polymer manufactured by Sanncor Industries and is supplied as a clear to translucent colloidal dispersant at approximately 30% by weight total solids. This second aliphatic urethane polymer has increased strength over the other Sancure®867 and in parts an improved hardness to the coating. Both of these aliphatic water borne urethane polymers are curable using a variety of water-based curing agents which cause crosslinking and thereby enhance the autoclave resistance of the resulting film. It should be noted that crosslinking should not significantly affect the coefficient of friction which the coating imparts to the rubber product. It does, however, materially affect the ability to adhere to the rubber and survive the various tests which are necessary.

A preferred crosslinking agent is a commercial grade hexamethoxy methyl melamine such as the commercially available hexamethoxy methyl melamine marketed by American Cyanamid Company under the trade name Cymal®303. This crosslinking agent may be used with either of the Sanncor aliphatic water borne polymers described above to achieve crosslinked coatings according to the present invention.

Another aliphatic water borne urethane polymer which may be crosslinked with the hexamethoxy methyl melamine resins described above is the Polyvinyl Chemicals Industries aliphatic water borne urethane polymer sold under the name NeoRez®R-966 and R-967. Polyvinyls Chemical Industries is a division of ICI. This urethane polymer is supplied in water solution of approximately 33% by weight of the aliphatic urethane. Crosslinking of the resin with Cymal®303 made by American Cyanamid or other crosslinking agents yields an effective hard coating which adheres to the rubber product and which lowers the coefficient of friction of the resulting product in the manner described herein.

It is contemplated that occasionally the urethane polymers used in the present invention to coat the elastomeric components will not provide a coating which is adequately water resistant even after crosslinking as described above. In such cases, the addition of an additional synthetic resin to the coating may appropriately improve the water resistance. For example, Polyvinyl Chemicals Industries applies an aqueous acrylic propolymer under the trade name m-NeoCryl ®A-622 which is an acrylic copolymer which is suitable for improving the water resistance in coatings. Normally, it is not necessary to modify the water resistance of the urethane resin.

For the purposes of this invention, the coefficient of friction of various elastomeric products is defined as follows. The coefficient of friction is the ratio of the frictional force resisting movement of the surface being tested to the force applied normal to the surface. In this case, the surface was a stainless steel plane. Four rubber stoppers were fixtured in a 256 gram weight such that they all lie on he stainless steel plane. The incline of the plane was then increased until the weight just started to slide, at which point the plane was locked and the angle was noted. The tangent of the angle is the static coefficient of friction.

It has been discovered that there is a correlation between the coefficient of friction as defined above for various products coated with polyurethane coatings and the 100% modulus of the coating. The 100% modulus is, of course, defined in the usual way. Specifically, modulus is defined as the ratio of nominal stress to corresponding strain. In this case, the modulus is considered at 100 percent strain and is expressed in pounds per square inch.

The modulus can range from less than 1000 psi to over 5000 psi or higher and will directly impact upon the coefficient of friction. It has been discovered that coatings having a 100% modulus ranging from 1000 psi to 5000 psi generally have coefficients of friction in the range which is desired for most centrifugal feed processing equipment.

In order to demonstrate the efficacy of the present invention, the following experiments were performed. In each example, the modulus of the coating was between 1000 psi and 5000 psi.

EXAMPLE 1

A mixture was made of 43.6 pounds of R-967 urethane polymer, 2.7 pounds of Cymel ® curing agent, and 6.6 pounds of water. Pharmaceutical rubber stoppers were spray coated to a thickness of 1.2 mils. They were then cured for 6.5 minutes in an I.R. tunnel. Coefficient of friction was reduced from 1.7 on the uncoated stopper to 0.7 on the coated stopper.

EXAMPLE 2

A mixture of three products manufactured by Sanncor Industries, Inc. was made of 60.2 pounds of S-867 urethane polymer, 45 pounds of S-847 urethane polymer, 5 pounds of Sanncur 87 curing agent, and 4 pounds of water. Pharmaceutical rubber stoppers were spray coated to a thickness of 1.0 mils. They were then cured for 6.5 minutes in an I.R. tunnel. Coefficient of friction was reduced from 1.7 on the uncoated stopper to 0.2 on the coated stopper. Standard testing of the stoppers following United States Pharmacopeia methods showed no significant change in other stopper properties.

EXAMPLE 3

A mixture was made of 178.7 pounds of S-847 polyurethane, 8.7 pounds Sanncur 87 curing agent, and 4.2 pounds of water. Pharmaceutical rubber stoppers were spray coated to a thickness of 1.2 mils. They were cured in an I.R. tunnel for 6.5 minutes. Coefficient of friction was reduced from 1.7 on the uncoated stopper to 0.2 on the coated stopper standard testing of the stoppers following United States Pharmacopeia methods showed no significant change in other stopper properties.

EXAMPLE 4

A mixture of 43.6 pounds of Polyvinyl's R-967 urethane polymer, 2.7 pounds of Cymel ®303 curing agent, and 6.6 pounds of water. Pharmaceutical rubber stoppers were spray coated to a thickness of 1.2 mils. They were cured in an I.R. tunnel for 6.5 minutes. Coefficient of friction was reduced from 1.7 on the uncoated stopper to 0.7 on the coated sample.

Presented below in Table I are the results of tests performed to demonstrate the suitability of the coated stoppers when compared to commercial stoppers. The values for each test are considered totally acceptable for use in pharmaceutical packaging.

TABLE I

Properties of Polyurethane-Coated Pharmaceutical Elastomers

| | Uncoated | Coated |
|---|---|---|
| COF | 1.34 | 0.27 |
| Autoclave Stability | | |
| 1 hour at 250° F. | No Effect | No Effect |
| Toxicity | Non-toxic | Non-toxic |
| Particle Generation (particles f 5 microns per stopper) | 122 | 250 |
| USP-NF Testing | | |
| pH shift (pH units) | 0.3 | 0.3 |
| Nephelos (turbidity) | 6.0 | 2.0 |
| Reducing Substances (mls $I_2$) | 0.02 | 0.13 |
| Total Solids (mg/100 mls) | 3.6 | 5.4 |
| Extractable Zinc (ppm) | 0.47 | 0.20 |
| Heavy Metals (Pb, ppm) | 0.0 | 0.0 |

EXAMPLES

Examples of Operation

One hundred pounds of S-867 urethane polymer were mixed with 10 pounds of Sanncor's S-847 urethane polymer, and 5.5 pounds of Cymel ®303 curing agent. Pharmaceutical rubber stoppers were spray coated with 1.0 mils on the flange side and 0.8 mils on the cup side. The stoppers were trimmed and washed. They were then autoclave sterilized at 135° for 12 minutes. They were then loaded in a stoppering machine; the maximum speed of the stoppering machine was 330 vials per minute. The stoppering machine operated at maximum speed using the polyurethane coated stoppers, and demonstrated a significant improvement. The standard operating speed using uncoated stoppers lubricated with silicone oil was 220 vials per minute.

What is claimed is:

1. A stopper device for use on a pharmaceutical closure, comprising:

an elastomeric stopper sized to function as a closure; and a polyurethane coating on said stopper, said coating having a modulus sufficient to decrease the coefficient of friction of said stopper to less than 0.6.

2. The device of claim 1, wherein said coefficient of friction ranges from about 0.35 to about 0.45.

3. The device of claim 1, wherein said polyurethane coating has been crosslinked after application on said stopper.

4. The device of claim 3, wherein said polyurethane is a water soluble polyurethane.

5. The device of claim 1, wherein said modulus ranges from 1000 psi to 5000 psi.

6. The device of claim 1, wherein said coating thickness is at least 0.2 mil.

7. The device of claim 6, wherein said coating ranges from 0.2 to 1.5 mil.

8. A stopper device for use on a pharmaceutical closure, comprising:

an elastomeric stopper sized to fit said closure and having a coefficient of friction of at least 1.2 and a water soluble crosslinked polyurethane coating on said stopper, said coating having a modulus between 1000 psi and 5000 psi and a thickness of from about 0.4 to 1.5 mil, to decrease the coefficient of friction of said stopper to between 0.45 and 0.60.

9. An elastomeric component for use in a pharmaceutical device, comprising:

an elastomeric part sized to function as said component; and a polyurethane coating on said part, said coating having a modulus sufficient to decrease the coefficient of friction of said part to less than 0.60.

10. The device of claim 9, wherein said coefficient of friction ranges from about 0.35 to about 0.45.

11. The device of claim 9, wherein said polyurethane coating has been crosslinked after application on said part.

12. The device of claim 11, wherein said polyurethane is a water soluble polyurethane.

13. The device of claim 9, wherein said modulus ranges from 1000 to 5000 psi.

14. The device of claim 9, wherein said coating thickness is at least 0.4 mil.

15. The device of claim 14, wherein said coating ranges from 0.2 to 1.5 mil.

* * * * *